US006295520B1

(12) United States Patent
Tian

(10) Patent No.: US 6,295,520 B1
(45) Date of Patent: Sep. 25, 2001

(54) MULTI-PULSE SYNTHESIS SIMPLIFICATION IN ANALYSIS-BY-SYNTHESIS CODERS

(75) Inventor: Wenshun Tian, Singapore (SG)

(73) Assignee: Tritech Microelectronics Ltd., Singapore (SG)

( * ) Notice: Subject to any disclaimer, the term of this patent is extended or adjusted under 35 U.S.C. 154(b) by 0 days.

(21) Appl. No.: 09/268,540

(22) Filed: Mar. 15, 1999

(51) Int. Cl.[7] ..... G10L 19/12
(52) U.S. Cl. ..... 704/223; 704/220; 704/219
(58) Field of Search ..... 704/221–223, 704/264, 219, 220, 211

(56) References Cited

U.S. PATENT DOCUMENTS

| | | | | |
|---|---|---|---|---|
| 4,944,013 | | 7/1990 | Gouvianakis et al. | 704/219 |
| 5,233,660 | * | 8/1993 | Chen | 704/208 |
| 5,651,091 | * | 7/1997 | Chen | 704/223 |
| 5,680,507 | * | 10/1997 | Chen | 704/223 |
| 5,701,392 | | 12/1997 | Adoul et al. | 704/219 |
| 5,745,871 | * | 4/1998 | Chen | 704/207 |
| 5,754,976 | | 5/1998 | Adoul et al. | 704/223 |

OTHER PUBLICATIONS

"Dual Rate Speech Coder for Multimedia Communications Transmitting at 5.3 and 6.3 kbit/s", International Telecommunication Union Telecommunication Standardization Sector (ITU–T), Geneva, Switzerland, (1996).

* cited by examiner

*Primary Examiner*—David D. Knepper
(74) *Attorney, Agent, or Firm*—Geroge O. Saile; Stephen B. Ackerman; Billy Knowles

(57) ABSTRACT

Speech is synthesized by optimizing frame data containing an excitation signal and impulse response filter coefficients, and convolving the excitation signal and impulse response filter coefficients more efficiently and with fewer multiplications and additions. The method to convolve begins by determining a number of non-zero pulses within said excitation signal. The pulse locations are sorted for the zero and non-zero pulses. The non-zero pulses are then ranked in order of time. The codebook contributions for the synthesized output signal having an index value less than a lowest rank non-zero pulse are set to a zero value. Each remaining codebook contribution for the synthesized signal is determined by convolving each non-zero pulse within said excitation signal with each impulse response function.

6 Claims, 4 Drawing Sheets

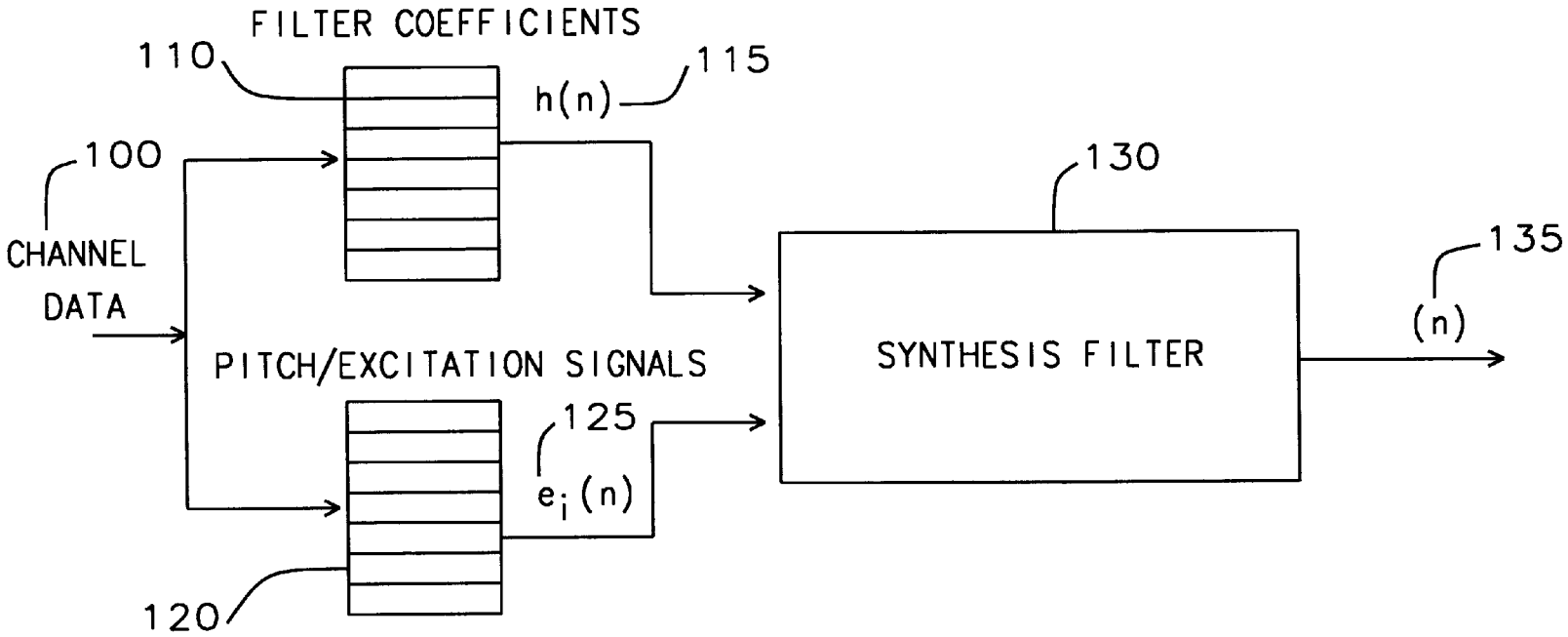
FIG. 1 – Prior Art

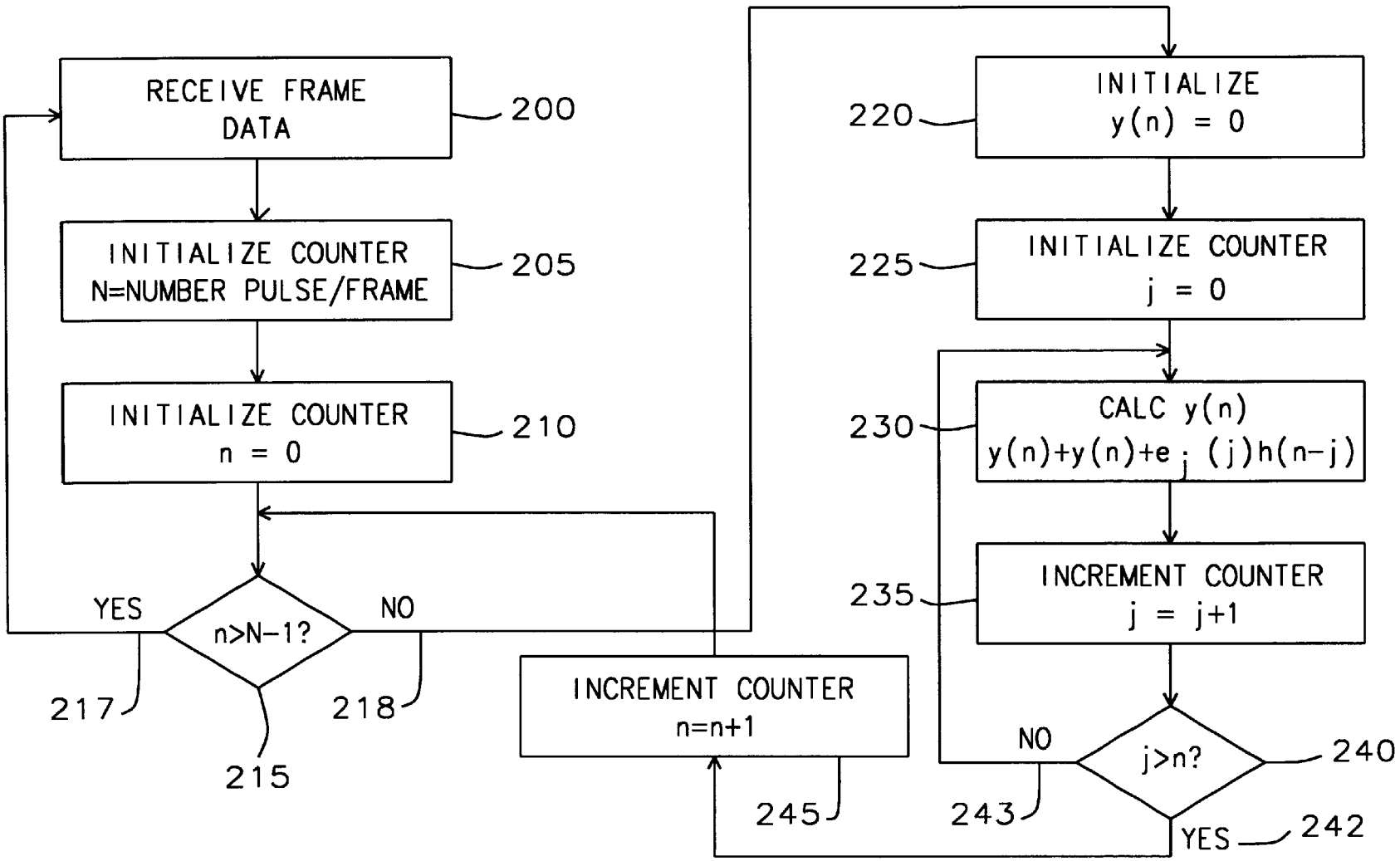
FIG. 2 – Prior Art

MULTI-PULSE SYNTHESIS SIMPLIFICATION IN ANALYSIS-BY-SYNTHESIS CODERS

BACKGROUND OF THE INVENTION

1. Field of the Invention

This invention relates to the methods and apparatus for the encoding and decoding of analog signals such as sound and more particularly speech signals to and from digital codes. More particularly this invention relates to methods and apparatus to convolve excitation signals with impulse response functions to form the sound contributions that form a synthesized output sound signal.

2. Description of the Related Art

The structure and function of a codebook excited linear predictive (CELP) coder is well known in the art. The specification for the International Telecommunication Union Telecommunication Standardization Sector (ITU-T) has published a recommended standard entitled "Dual Rate Speech Coder for Multimedia Communications Transmitting at 5.3 and 6.3 k bit/s," G.723.1, 1996, Geneva, Switzerland that specifies a coded representation that can be used for compressing speech or other audio signals for transmission at very low bit rates.

A speech coder complying with G.723.1 has an input of 16 bit linear Pulse Code Modulated sampled digital data. The sampling has a frequency rate of 8000 Hz. The samples are partitioned into frames of 240 samples that have a duration of 30 ms.

The faster transmission rate of 6.3 k bits/s uses a multi pulse maximum likelihood algorithm to quantize each frame. And the slower transmission rate of 5.3 k bits/s uses an algebraic code-excited linear predictor algorithm to quantize each frame.

The digital channel data transferred from the encoding source to the decoder is the linear split predictor indices, the adaptive codebook gain and lag (the pitch information), the fixed codebook index and gain (the residual information).

FIG. 1 shows a simplified block diagram of a decoder as shown in FIGS. 1 and 2 of G.273.1 and included herein by reference.

The channel data 100 is divided and preprocessed into the filter coefficients h(n) 115, which are retained in the buffer 110, and the pitch/excitation signals 125 which are retained in the buffer 120. The filter coefficients h(n)115 determine the filter characteristics of the synthesis filter 130. The excitation signals $e_i(n)$ 125 are then the input stimuli to the synthesis filter 130. The excitation signals $e_i(n)$ 125 are then filtered to provide the synthesis speech signal y(n) 135 for a frame of 240 samples. The synthesis speech signal y(n) 135 is a digital signal that is the input to a digital-to-analog converter (DAC) that will reproduce a facsimile of the original audio signal.

It is well known in the art that the filtering process is a convolving of the excitation signals $e_i(n)$ 125 with the filter coefficients h(n)115. The convolution of the excitation signals $e_i(n)$ 12 with the filter coefficients h(n) is described according to the following function $$y(n) = e_i(n) * h(n) = \sum_{j=0}^{n} e_i(j)h(n-j) \qquad \text{Eq. 1}$$

where:

n is an index having a value of from $0 \leqq n \leqq N-1$.

N is the number of samples within a frame of quantized speech.

j is an index counter for the performance of the summation.

$e_i(n)$ is the element of the vector $e_i$ of the excitation signal 125.

h(n) is the vector of the filter coefficients 115.

y(n) is the synthesized speech signal 135.

FIG. 2 is a flow diagram of the operations necessary to complete the convolution of Eq. 1. A frame of the digital data describing the excitation signal $e_i$n) and the impulse response with the filter coefficients h(n) is received and retained 200. A counter is initialized 205 to the number N of the pitch impulses or samples within the frame. The index counter n is initialized 210 to zero and then tested 215 if the counter is greater than one less than the number of samples N in the frame. If the counter is not 218 greater than one less than the number of samples N in the frame, the value of the synthesized speech signal y(n) is initialized 220 to zero. The counter j for the summation is also initialized to zero. The contribution to the synthesized speech signal y(n) is then calculated 230 by the equation:

$$y(n)=y(n)+e_i(n)h(n-j). \qquad \text{Eq. 2}$$

n=0 to (n−1)

The counter j for the summation is then incremented 235 and tested if it has exceeded the value of the index counter n. If the counter j has not 243 exceeded the value of the index counter n, an updated value of the synthesized speech signal is calculated 230 with new excitation signals $e_i(j)$ and new impulse response coefficients h(n−j) as described in Eq. 2. This reiterates until the value of the counter j of the summation is greater than 242 the value n of the index counter. When the value of the counter j is greater than 242 the index counter n, the index counter n is then incremented 245 and then compared 215 to one less than the number of samples N.

The above described steps are repeated until the index counter reaches the value of the number of samples N, at this point all contributions to the synthesized speech signal y(n) are determined and a new frame of the digital data is received 200.

A calculation of one contribution to the synthesized speech signal y(n) requires (N+1)N/2 multiplications and (N−1)N/2 additions. This calculation of the algorithm has a delay of 37.5 ms.

U.S. Pat. No. 5,754,976 (Adoul et al. 976) describes a method and device for drastically reducing the complexity of a codebook search while encoding a sound signal. The method and device is capable of selecting a priori a subset of the codebook pulse combinations and restraining the combinations to search to the subset. Further, the size of the codebook is increased by allowing the individual code vectors to assume at least one of multiple possible amplitude, while not increasing search complexity.

U.S. Pat. No. 5,701,392 (Adoul et al. 392) provide methods for an algebraic codebook search to encode speech signals. The codebook of Adoul et al 392 consists of a set of code vectors in 40 positions and each comprising multiple non-zero amplitudes assignable to predetermined positions. To reduce the search complexity, a depth-first search is used which involves a tree structure with ordered levels. A path building operation takes place. A path originated at the first level and extended by the path building operations of subsequent levels determine the respective positions of the non-zero amplitudes of a candidate code vector. A signal-based pulse-position likelihood estimate is used during the first few levels to enable initial pulse screening to start the search on favorable conditions.

U.S. Pat. No. 4,944,013 (Gouvianakis et al.) teaches a method of coding speech such that it can be generated by a pulse excitation sequence in a linear predictive coding filter. The sequence contains, in each of successive frame periods, pulse whose positions and amplitudes may be varied. These variables are selected at the coding end to reduce the error between the input and regenerated speech signals. The selection process involves derivation of an initial estimate followed by an iterative adjustment process in which pulses having low energy contributions are tested in alternative positions and transferred to them if a reduced error results.

SUMMARY OF THE INVENTION

An object of this invention is to provide a method and device to encode frame data containing an excitation signal and impulse response filter coefficients, convolve the excitation signal and impulse response filter coefficients, and to produce a synthesized speech from the excitation signal and impulse response filter coefficients.

Another object of this invention is to provide a method to convolve the excitation signal and impulse response filter coefficients more efficiently and with fewer multiplications and additions.

To accomplish these and other objects a method to convolve begins by determining a number of non-zero pulses within the excitation signal. The pulse locations are sorted for the zero and nonzero pulses. The non-zero pulses are then ranked in order of time. The codebook contributions for the synthesized output signal having an index value less than a lowest rank non-zero pulse are set to a zero value.

Each remaining codebook contribution for the synthesized signal is determined by convolving each non-zero pulse within the excitation signal with each impulse response function according to the equation:

$$y(n) = \sum_{j=0}^{n} e(n-j)h(j)$$

where:

n is the index value.

y(n) is the codebook contribution to the output signal of the index value.

j is the counter variable of the summation.

e(n−j) is a value for the excitation signal at the index (n−j).

h(j) is the impulse response function at index j.

The convolution of each codebook contribution is found by solving the equation:

$$y(n) = \sum_{k=0}^{x} \alpha_k h(n-m_k)$$

where:

n is the index value.

x is a rank index value of the non-zero pulses of the excitation signal.

y(n) is the codebook contribution to the output signal of the index value.

k is the counter variable of the summation.

$\alpha_k$ is a sign value of the non-zero pulse of the excitation signal at the index k.

$h(n-M_k)$ is the impulse response function at index $(n-m_k)$.

Further, to accomplish the above objects, a codebook excited linear prediction coder will synthesize an analog output signal from a set of impulse excitation signals and a set of impulse response functions provided as an input to the coder. The coder has a convolver means to convolve the impulse excitation signals with impulse response functions to form a synthesized speech output signal. The convolver means consists of a means to receive, index and retain a frame of pulses of the excitation signal and a means to receive, index and retain the impulse response functions. The convolver means further has a counting means connected to the means retaining the excitation signal to determine a number of non-zero pulses with the excitation signal.

A sorting means is connected to the means retaining the excitation signal to sort the pulse locations of the excitation signal according to zero and non-zero pulses, and a ranking means is connected to the means retaining the excitation signal to rank non-zero pulses in order of time. An output generation means is connected to the means retaining the excitation signal and the means retaining the impulse response functions to set codebook contributions of the synthesized output signal to a zero level for contents of the means retaining the excitation signal having index values less than the lowest ranked non-zero pulse. The output generation means then determines each codebook contribution for the synthesized output signal by convolving each non-zero pulse within the excitation signal with each impulse response function according to the equation:

$$y(n) = \sum_{k=0}^{n} e(n-k)h(k)$$

where:

n is the index value.

y(n) is the codebook contribution to the output signal of the index value.

k is the counter variable of the summation.

e(n−k) is a value for the excitation signal at the index (n−k).

h(k) is the impulse response function at index k.

The output generation means determines each codebook contribution by solving the equation:

$$y(n) = \sum_{k=0}^{x} \alpha_k h(n-m_k)$$

where:

n is the index value.

x is a rank index value of the non-zero pulses of the excitation signal.

y(n) is the codebook contribution to the output signal of the index value.

k is the counter variable of the summation.

$\alpha_k$ is a sign value of the non-zero pulse of the excitation signal at the index k.

$h(n-m_k)$ is the impulse response function at index $(n-m_k)$.

BRIEF DESCRIPTION OF THE DRAWINGS

FIG. 1 is a simplified block diagram of an audio synthesizer of the prior art.

FIG. 2 is a flow diagram of a method to synthesize a speech signal from an excitation signal and impulse response filter coefficients of the prior art.

DETAILED DESCRIPTION OF THE INVENTION

It is well known in the art that the majority (approximately 90% in the case of G.273.1) of the contents of the excitation signal $e_i(n)$ have a zero magnitude and will thus have no contribution to the synthesized speech signal y(n). In the method of convolving the excitation signal $e_i(n)$ and the impulse response filter coefficients h(n) as described in FIG. 2, no consideration is given to eliminating the computations that would have an automatic zero result for the synthesized speech signal. This presents an excess computational burden on the device performing these calculations.

Figure 3A:
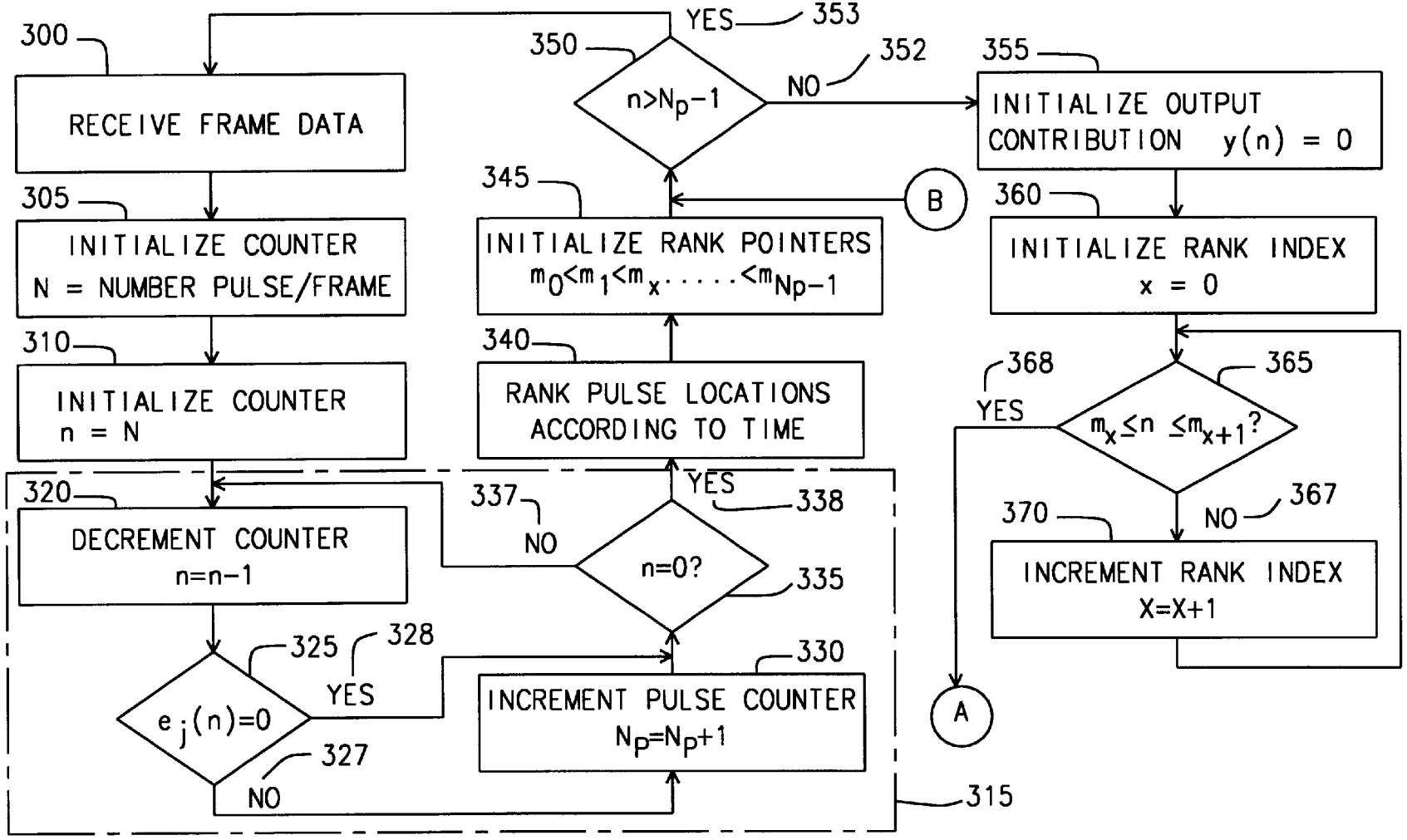
FIGS. 3*a* and 3*b* are flow diagrams of a method to convolve an excitation signal with impulse response filter coefficients to synthesize an audio signal of this invention.
Figure 3B:
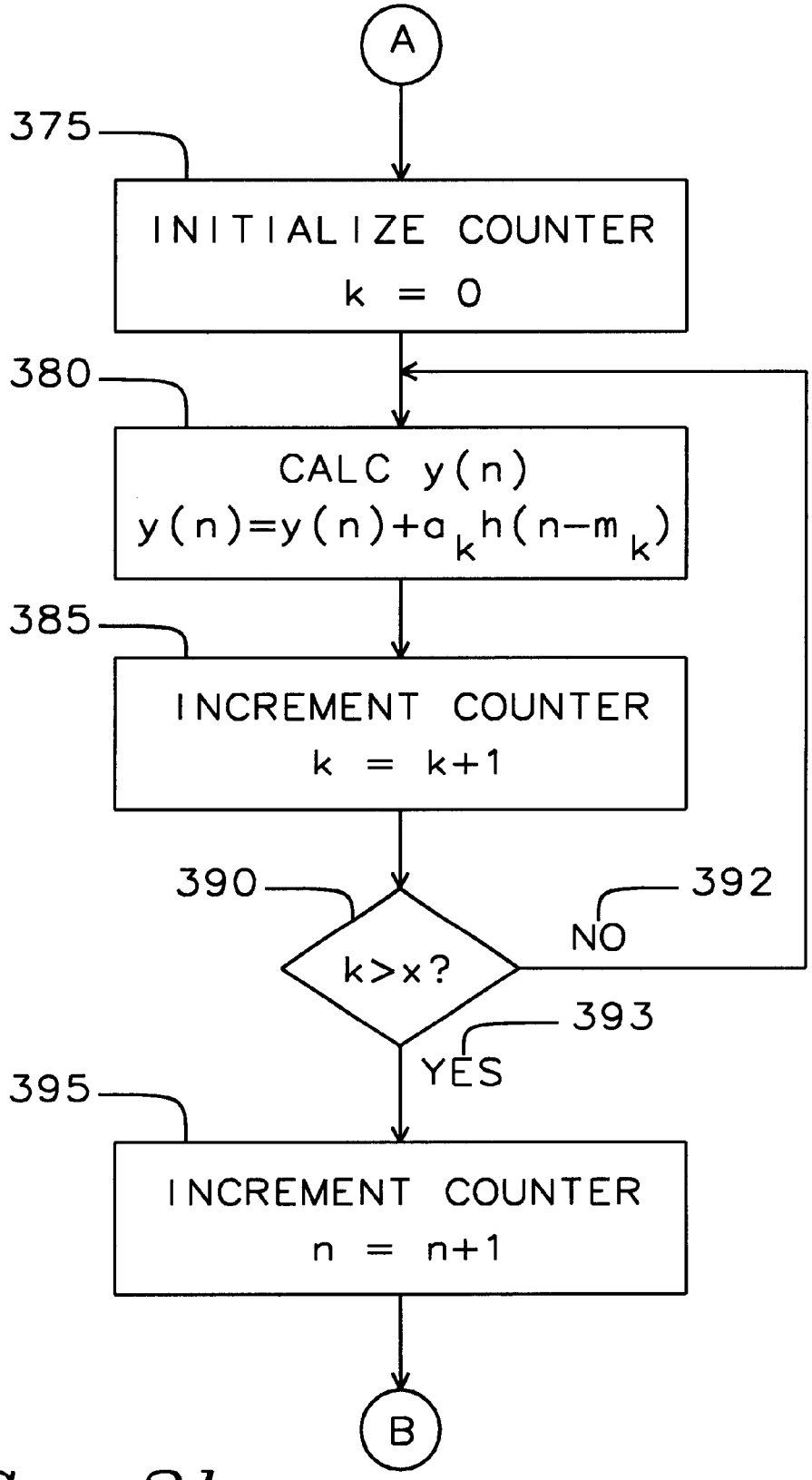

FIGS. 3*a* and 3*b* show a method that an apparatus, such as shown in FIG. 1, could implement to reduce the number of multiplications and additions required to perform the convolution of the excitation signal $e_i(n)$ and h(n) to create the synthesized speech signal. The method first sorts the excitation signal $e_i(n)$ to separate the zero value components of the excitation signal $e_i(n)$ from the non-zero excitation value $e_i(n)$. The non-zero excitation values $e_i(n)$ are ranked in order the pulse location $\{m_\iota\}$ for $_\iota$=0,1,2,3, . . . During the optimization procedure, the pulse location $\{m_\iota\}$ of the individual pulse locations $m_0$, $m_1$, $m_2$, $m_3$, . . . are found based the magnitude of their contributions to the means square error. The pulse locations $\{m_\iota\}$ are found by arranging the ranking such that the individual pulse locations $\{m_k\}$ is according to the function:

$$\{m_k\}<\{m_{k+1}\}.$$

The non-zero excitation ranking are designated by $m_k$ and contain the index of each excitation signal $e_i(n)$. The method of FIGS. 3*a* and 3*b* further provides a solution to the equation:

$$y(n) = e(n) * h(n)$$

$$= \sum_{j=0}^{n} e(n-j)h(j)$$

$$= \begin{cases} 0, & 0 \le n < m_0 \\ \alpha_0 h(n-m_0), & m_0 \le n < m_1 \\ \sum_{k=0}^{1} \alpha_k h(n-m_k), & m_1 \le n < m_2 \\ \cdots \\ \sum_{k=0}^{N_p-1} \alpha_k h(n-m_k), & m_{N_p-1} \le n < N \end{cases}$$

where:

- n is the index value.
- y(n) is the codebook contribution to the output signal of the index value.
- N is the number of pitch impulses or samples within a frame of quantized speech.
- $e_i(n)$ is a vector of the excitation signals at the index n. The information contained in the vector is the amplitude, position within a frame, and pitch of each impulse.
- h(n) is the vector of the filter coefficients of the frame.
- j is the counter variable of the summation.
- $m_k$ is the rank variable of each non-zero pulse within the vector of excitation signals.
- $\alpha_k$ is the sign value of the excitation signal $e_i(n)$ having index j.
- $h(n-m_k)$ is the vector of filter coefficients having index $(n-m_k)$.

Refer now to FIGS. 3*a* and 3*b* for an explanation of the method of convolution. A frame of the digital data describing the excitation signal $e_i(n)$ and impulse response filter coefficients h(n) is received and retained 300. The counter indicating the number of pulses N within a frame is initialized 310 to contain the number of pulses N.

The number of non-zero pulses Np is determined 315 by the following process. The index counter n is decremented 320. The excitation signal $e_i(n)$ having index n is compared 325 to zero. If it is not zero 327 then the non-zero counter $N_p$ is incremented 330. The index counter n is compared 335 with zero. If the index counter is not zero 337, the index counter n is decremented and each excitation signal $e_i(n)$ is examined 325. Those that are zero 328 are ignored and the process iterated until the index counter reaches zero 338.

The non-zero pulse locations are ranked 340 in order of time. The rank pointers $m_0$, $m_1$, . . . $m_{Np-1}$ are initialized 345 to contain the indices of the non-zero excitation signal $e_i(n)$.

The index counter n is checked 350 at this point to see if all the contributors to the synthesized speech signal are determined. If all the contributors have not been determined 352, the current contributor y(n) to the synthesized speech is initialized 355 to zero and a rank index x is initialized 360 to zero.

The contents of the rank pointers m having the current value of the rank index x, the next current value of the rank index x+1 (i.e. $m_x$ and $m_{x+1}$) are compared 365 to the current value of the index counter n. If the current value of the index counter is not 367 between the contents rank pointers $m_x$ and $m_{x+1}$, the rank index x is incremented 370 and thus the rank pointers until the contents of the rank pointers $m_x$ and $m_{x+1}$ are such that $m_x \leqq n < m_{x+1}$ 368.

At this point, the summation counter k is initialized 375 to zero. The contribution to the synthesized output signal is calculated 380 according to the equation $$y(n)=y(n)+\alpha_k h(n-m_k).$$

The summation counter k is incremented 385.

The summation counter is compared 390 to the value of the rank index x to insure that all contributors y(n) to the synthesized speech are calculated. If not 392, the calculation 380 is iteratively performed until the summation counter k achieves 393 the value of the rank index x. The index counter n is incremented 395 and compared 350 to one less than the number of non-zero pulses $N_p-1$. The above steps are iterated until all the contributors y(n) to the synthesized speech for the current frame are calculated. Once the value of the index counter n exceeds 353 the number of non-zero pulse $N_p-1$, the next frame of data is received and retained 300 and the process is reiterated.

It would be apparent to those skilled in the art that the above described method would be implemented in a device similar to that of FIG. 1. The impulse response filter coefficients h(n) 115 are received and retained in the buffer 100 and the excitation signals 125 are received and retained in the buffer 120. The synthesis filter 130 contains circuitry that will control and perform the operations of the method of FIGS. 3*a* and 3*b*.

By eliminating the multiplications and additions for the non-zero impulses for determining the contributions to the synthesized speech signal, the number of multiplications now become:

$$[0+1(m_1-m_0)+2(m_2-m_1)+3(m_3-m_2)+\ldots+N_p(N-m_{Np-1})]$$

and the number of additions become:

$$[0+0(m_1-m_0)+1(m_2-m_1)+2(m_3-m_2)+\ldots+(N_p-1)(N-m_{N_p-1})]$$

The worst case number of calculations occurs when all the pulses are located at the beginning of the frame. In this case the number of multiplications is determined to be:

$$\begin{aligned}[1+2+3+\ldots+N_p-1+N_p(N-(N_p-1))] &= [1+2+3+\ldots+N_p+(N-N_p)N_p] \\ &= \left(N+\frac{1-N_p}{2}\right)Np \\ &= \left(N-\frac{N_p-1}{2}\right)Np\end{aligned}$$

The number of additions are determined to be:

$$\begin{aligned}[1+2+3+\ldots+N_p-2+(N_p-1)(N-(N_p-1))] &= [1+2+3+\ldots+(N_p-1)+(N_p-1)(N-N_p)] \\ &= \left(N+\frac{1-N_p}{2}\right)N_p-N \\ &= \left(N-\frac{N_p}{2}\right)(N_p-1)\end{aligned}$$

To one skilled in the art creating a sorter to separate the zero pulses from non-zero pulse is apparent. The counters to determine the number $N_p$ of non-zero impulses, to maintain the index counter n, the rank index counter, and to summation counter are all well known. Also well known are methods for forming circuitry to perform the multiplications and additions to determine the synthesized speech contributions. Additionally, any comparator circuits necessary to make the decisions with regards to the progress of the method are well known in the art as well.

While this invention has been particularly shown and described with reference to the preferred embodiments thereof, it will be understood by those skilled in the art that various changes in form and details may be made without departing from the spirit and scope of the invention.

The invention claimed is:

1. A method to convolve an excitation signal with an impulse response function to form a synthesized output signal comprising the steps of:

determining a number of non-zero pulses within said excitation signal;

sorting pulse locations of said excitation signal;

ranking non-zero pulses in order of time;

setting codebook contributions for the synthesized output signal having an index value less than a lowest rank non-zero pulse to a zero value;

determining each codebook contribution for the synthesized signal by convolving each non-zero pulse within said excitation signal with each impulse response function according to the equation:

$$y(n)=\sum_{k=0}^{n} e(n-k)h(k)$$

where:

n is the index value, y(n) is the codebook contribution to the output signal of the index value, k is the counter variable of the summation, e(n−k) is a value for the excitation signal at the index (n−k), and h(k) is the impulse response function at index k.

2. The method of claim 1 wherein the determining each codebook contribution is found by solving the equation:

$$y(n)=\sum_{k=0}^{x} \alpha_k h(n-m_k)$$

where:

n is the index value, x is a rank index value of the non-zero pulses of the excitation signal, y(n) is the codebook contribution to the output signal of the index value, k is the counter variable of the summation, $\alpha_k$ is a sign value of the non-zero pulse of the excitation signal at the index k, and $h(n-m_k)$ is the impulse response function at index $(n-m_k)$.

3. An apparatus to convolve an excitation signal with impulse response functions to form a synthesized output signal, comprising:

a means to receive, index and retain a frame of pulses of said excitation signal;

a means to receive, index and retain said impulse response functions;

a counting means connected to the means retaining said excitation signal to determine a number of non-zero pulses with said excitation signal;

a sorting means connected to the means retaining said excitation signal to sort the pulse locations of said excitation signal;

a ranking means connected to the means retaining said excitation signal to rank non-zero pulses in order of time; and an output generation means connected to the means retaining said excitation signal and the means retaining the impulse response functions to set codebook contributions of the synthesized output signal to a zero level for contents of the means retaining the excitation signal having index values less than the lowest ranked non-zero pulse and to determine each codebook contribution for the synthesized output signal by convolving each non-zero pulse within said excitation signal with each impulse response function according to the equation:

$$y(n)=\sum_{k=0}^{n} e(n-k)h(k)$$

where:

n is the index value, y(n) is the codebook contribution to the output signal of the index value, k is the counter variable of the summation, e(n−k) is a value for the excitation signal at the index (n−k), and h(k) is the impulse response function at index k.

4. The apparatus of claim 3 wherein the output generation means determines each codebook contribution by solving the equation:

$$y(n) = \sum_{k=0}^{x} \alpha_k h(n - m_k)$$

where:

n is the index value, x is a rank index value of the non-zero pulses of the excitation signal, y(n) is the codebook contribution to the output signal of the index value, k is the counter variable of the summation, $\alpha_k$ is a sign value of the non-zero pulse of the excitation signal at the index k, and $h(n-m_k)$ is the impulse response function at index $(n-m_k)$.

5. A codebook excited linear prediction coder to synthesize an analog output signal from a set of impulse excitation signals and a set of impulse response functions provided as an input to said coder, whereby said coder is comprising:

a convolver means to convolve an excitation signal with impulse response functions to form a synthesized output signal, comprising:

a means to receive, index and retain a frame of pulses of said excitation signal;

a means to receive, index and retain said impulse response functions;

a counting means connected to the means retaining said excitation signal to determine a number of non-zero pulses with said excitation signal;

a sorting means connected to the means retaining said excitation signal to sort the pulse locations of said excitation signal;

a ranking means connected to the means retaining said excitation signal to rank non-zero pulses in order of time; and an output generation means connected to the means retaining said excitation signal and the means retaining the impulse response functions to set codebook contributions of the synthesized output signal to a zero level for contents of the means retaining the excitation signal having index values less than the lowest ranked non-zero pulse and to determine each codebook contribution for the synthesized output signal by convolving each non-zero pulse within said excitation signal with each impulse response function according to the equation:

$$y(n) = \sum_{k=0}^{n} e(n-k)h(k)$$

where:

n is the index value, y(n) is the codebook contribution to the output signal of the index value, k is the counter variable of the summation, e(n−k) is a value for the excitation signal at the index (n−k), and h(k) is the impulse response function at index k.

6. The coder of claim 5 wherein the output generation means determines each codebook contribution by solving the equation:

$$y(n) = \sum_{k=0}^{x} \alpha_k h(n - m_k)$$

where:

n is the index value, x is a rank index value of the non-zero pulses of the excitation signal, y(n) is the codebook contribution to the output signal of the index value, k is the counter variable of the summation, $\alpha_k$ is a sign value of the non-zero pulse of the excitation signal at the index k, and $h(n-m_k)$ is the impulse response function at index $(n-m_k)$.

* * * * *